United States Patent [19]

Crichlow

[11] 3,999,881

[45] Dec. 28, 1976

[54] CENTRIFUGAL PUMP OF THE PITOT TYPE

[75] Inventor: Walter W. Crichlow, La Habra Heights, Calif.

[73] Assignee: Kobe, Inc., Huntington Park, Calif.

[22] Filed: Sept. 2, 1975

[21] Appl. No.: 609,375

[52] U.S. Cl. ..... 415/89; 233/44

[51] Int. Cl.[2] ..... F04D 1/12

[58] Field of Search ..... 415/89, 88; 233/44, 233/45, 46

[56] References Cited

UNITED STATES PATENTS

| | | | |
|---|---|---|---|
| 3,051,089 | 8/1962 | Hany et al. | 415/89 |
| 3,384,024 | 5/1968 | King | 415/89 |
| 3,776,658 | 12/1973 | Erickson | 415/89 |
| 3,838,939 | 10/1974 | Erickson et al. | 415/89 |

FOREIGN PATENTS OR APPLICATIONS

| | | | |
|---|---|---|---|
| 1,176,486 | 8/1964 | Germany | 415/89 |

OTHER PUBLICATIONS

NASA Tech. Brief 68-10395, Oct. 1968, by Gerlach.

*Primary Examiner*—C. J. Husar

*Attorney, Agent, or Firm*—Christie, Parker & Hale

[57] ABSTRACT

The cross section of a flow passage in a pitot tube of a pitot tube pump begins as circular, becomes continuously changing to ovular during a change in passage direction from circumferential to radial, and, when the passage is radial, is long and narrow with parallel sides and curved ends. Within a given, generally ovular cross section the passage has its greatest width at larger radii. The inside wall of the passage curves gradually from the entrance towards the axis of the pump, and, towards the purely radial portion of the passage, curves relatively sharply. A perimeter of the pitot tube in planes perpendicular to the tube's radial axis and parallel to the circumferential component of fluid motion externally of the pitot tube is in the form of a fluid foil having a leading edge which is relatively blunt with respect to the trailing edge. The long axis of the fluid foil points into the fluid.

12 Claims, 12 Drawing Figures

Fig. 1
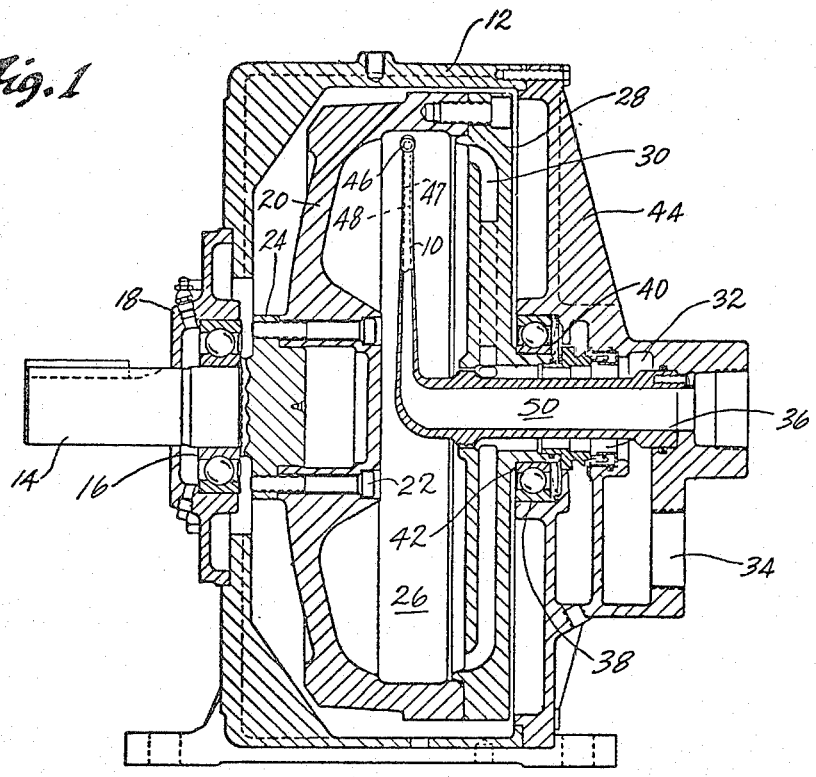
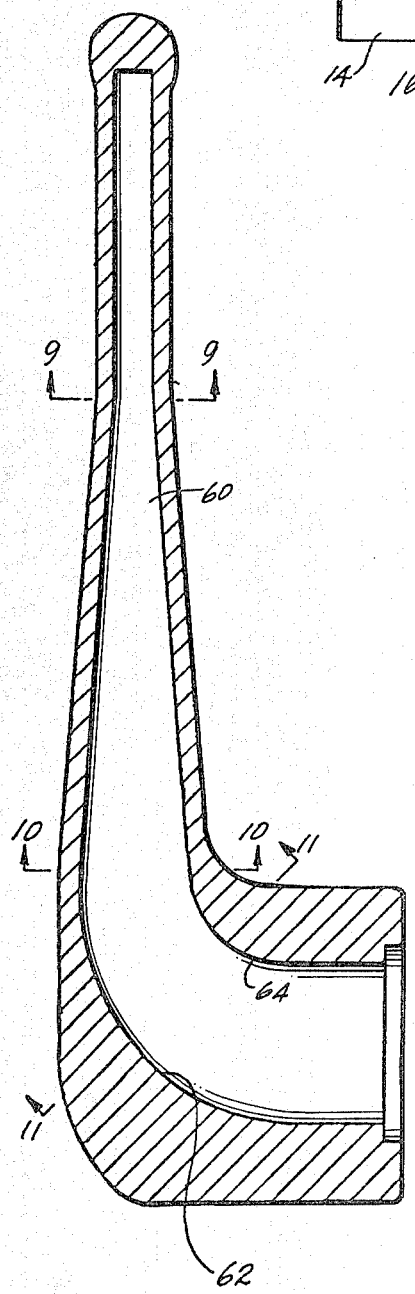
Fig. 2

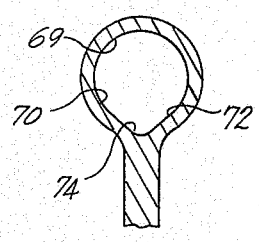
Fig. 4
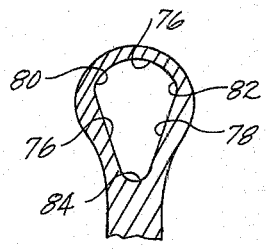
Fig. 5
Fig. 6
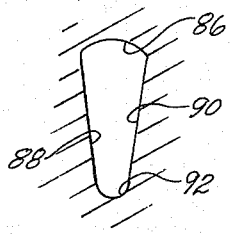
Fig. 7
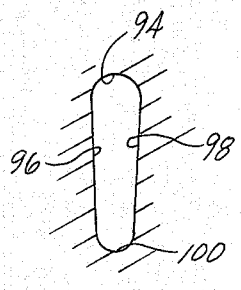
Fig. 8
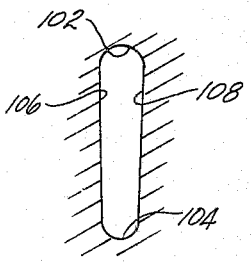
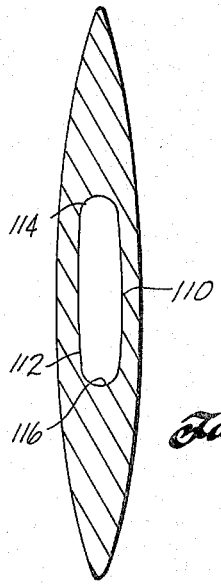
Fig. 9

CENTRIFUGAL PUMP OF THE PITOT TYPE

BACKGROUND OF THE INVENTION

The present invention relates to centrifugal pumps in general, and, more in particular, to centrifugal pumps of the pitot tube type and to improvements in the pitot tube geometry of such pumps.

Pitot tube type centrifugal pumps are known. An illustrative description of such a pump can be found in U.S. Pat. No. 3,384,024 to King.

In general, the pumps have a rotor driven in rotation by a prime mover. The rotor houses a stationary pitot tube. The pitot tube extends radially in a cavity in the rotor and has a passage for passing fluid. The pitot tube has an entrance for receiving fluid proximate the outer radial boundary of the rotor cavity. This fluid has received an energy input from the prime mover through the rotor. Typically, some of the velocity head of the fluid in the pitot tube is changed to pressure head through a diffuser.

Pitot tube pumps are relatively efficient and have good pressure and flow rate characteristics. It is obviously desirable to have these pumps as efficient as possible. Fluid losses occasioned through boundary layer separation in the pitot tube is an area of concern. Another area of concern is pitot tube drag.

The pitot tube defines a flow passage which is circumferential at its entrance, turns to become radial and then turns again to become axial of the rotor. These two turns are about 90°, the first being slightly greater. Clearly separation of fluid from the walls as the fluid traverses these turns adds to flow loss. The possibility of avoiding substantial flow losses in bends by increasing the flow cross-sectional area on the inside of the bend is discussed in NASA Tech Brief 68-10395 by Gerlach.

SUMMARY OF THE INVENTION

The present invention provides in a pitot tube pump an improved pitot tube of simple configuration and which reduces flow losses especially between the entrance and radial part of the passage of the tube.

The reduction in flow loss is believed to be by the changing of the cross section of the pilot tube passage from circumferential at the entrance to long and narrow at a radial portion of the passage through generally ovular transitional cross sections. These ovular sections narrow along the flow path faster at smaller radii than at larger radii. The entrance is oriented to receive fluid circulating circumferentially about the axis of rotation of the rotor of the pump within the rotor. Stated in different words, the circular cross section at the entrance gradually changes and narrows as the passage turns to purely radial. This narrowing takes place most rapidly on the inside of the turn and the circular cross section disappears less rapidly on the outside of the turn. Preferably, the inside of the turn has a radius of curvature which is relatively large from the entrance of the passage to a point just upstream of the radial section of the passage, at which point the radius of curvature becomes relatively small.

The progression from circular to long and narrow cross sections through the ovular cross sections of the transition section of the passage may be done by ovals defined by V-shaped sides apexing at the inside of the turn and capped by circular arcs of the same radius as the entirely circular entrance. The length of the arcs progressively decrease along the transition section as the long and narrow section is approached.

In a particular form of the present invention, a pitot tube pump has a housing which contains a rotor. Prime mover means rotate the rotor about an axis. Passage means provide acceptance of fluid in a cavity of the rotor where the fluid is energized by the prime mover. A pitot tube mounted coaxially with the rotor has an entrance proximate the outer radial limit of the rotor cavity. The passage geometry of this pitot tube from circumferential to radial is as described. The radial portion of the passage thereafter has a constant cross-sectional area for a radial distance to eliminate entrance effects and the effects of turning on the passing fluid. The pitot tube passage continues radially after this "straightener" section as a diffuser and presents to fluid a constantly increasing cross-sectional area to convert velocity head to pressure head. The constantly increasing cross section in this diffuser is gained by progressively increasing the width of the passage transverse to the rotational direction of the rotor, as opposed to a direction paralleling such rotation. The passage turns from radial to axial at a hub of the tube for discharge of fluid. This turn is characterized by a large cross section on the inside of the turn and a small cross section on the inside of the turn and a small cross section on the outside of the turn in accordance with the NASA teaching cited previously. The outside of the pitot tube is streamlined to minimize drag. The outside of the tube is narrow facing the circumferential component of fluid motion and is relatively longer parallel to such fluid motion to accommodate the gradual turn of the pitot tube passage.

It has been found that the curvature and cross-sectional area transition between the entrance of the pitot tube passage and the radial portion of that passage reduce flow losses through the pitot tube of the pump without requiring external changes to the tube which would increase drag losses.

These and other features, aspects and advantages of the present invention will become more apparent from the following description, appended claims and drawings.

DESCRIPTION OF THE DRAWINGS

FIG. 1 is an elevational view, partly in half section, of a pitot tube pump employing the improved pitot tube of the present invention;

FIG. 2 is an elevational end view of the improved pitot tube of the present invention, which is at right angles to the direction of rotation of the pump;

FIG. 4 is a view taken along line 4—4 of FIG. 3;

FIG. 5 is a view taken along line 5—5 of FIG. 3;

FIG. 6 is a view taken along line 6—6 of FIG. 3;

FIG. 7 is a view taken along line 7—7 of FIG. 3;

FIG. 8 is a view taken along line 8—8 of FIG. 3;

FIG. 9 is a view taken along line 9—9 of FIG. 2;

DESCRIPTION OF THE PREFERRED EMBODIMENTS

Figure 3:
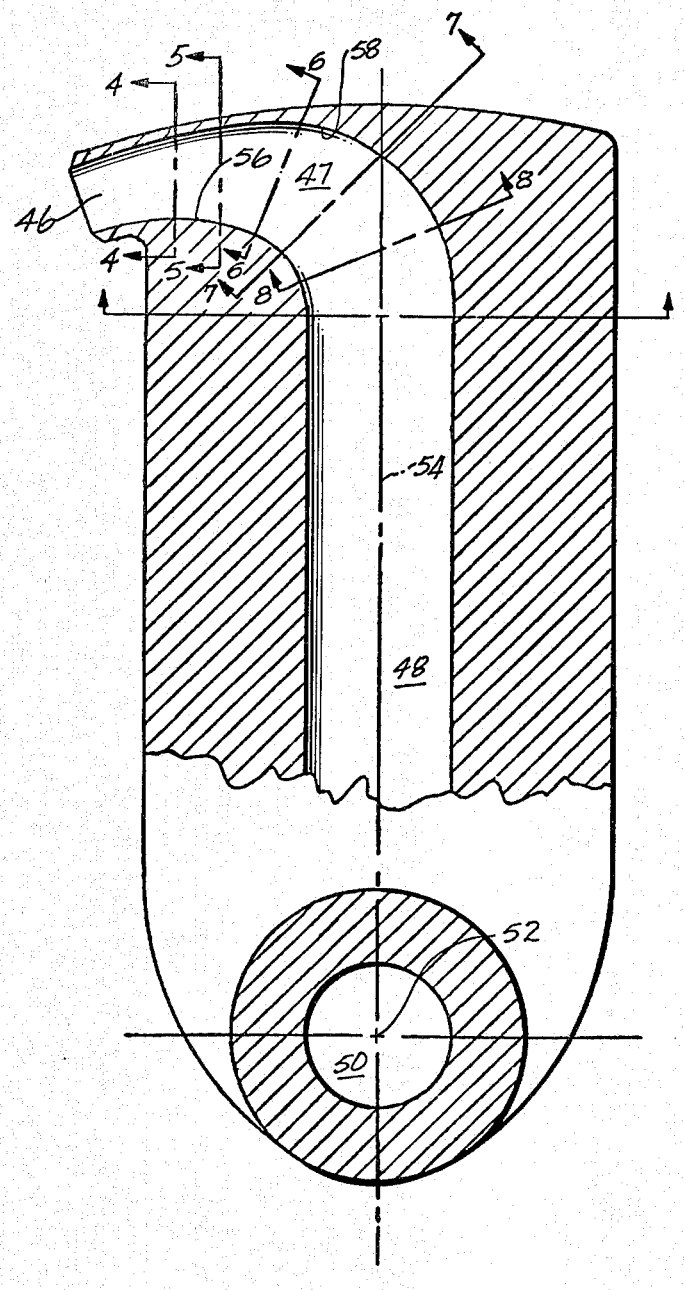
FIG. 3 is an elevational plan view of the improved pitot tube of the present invention, which is parallel to the direction of rotation of the pump.

FIG. 1 shows a pitot tube pump having a pitot tube 10. The pump has a housing 12 adapted to be stationarily mounted. A drive shaft 14 extends into this housing from a prime mover and is journaled in a bearing 16, which in turn is mounted to the housing through a bearing box 18. A rotor 20 attaches to the drive shaft as through cap screws 22 and a flange 24 of the drive shaft. The rotor defines a cavity 26 which is closed on one side by a cover 28. A plurality of radially extending passages 30 in the cover communicate with a source of fluid through an annulus 32 and an intake 34 into the annulus. A seal assembly 36 between the rotor and the housing keeps fluid in the annulus and intake. The rotor is journaled in a bearing 38 on a hub 40 of cover 28 and in recess 42 of a housing cover 44 of the housing.

Pitot tube 10 is stationary and extends axially into the hollow rotor from the housing and then radially of the rotor's axis of rotation so that an entrance 46 of a passage 47 of the pitot tube receives fluid energized by the prime mover through the rotor at an extreme radial location. The entrance is located for fluid entrance tangentially to the radius from the rotor's axis. From the entrance, the fluid passage turns from the purely circumferential to the purely radial at 48 and then to the purely axial at 50 just prior to leaving the pump. The passage grows in cross section to change velocity head to pressure head.

So much of a pitot tube type pump is known.

The pitot tube is shown in greater detail in FIGS. 2 and 3. In FIG. 3 passage 47 from entrance 46 curves from a circumferential orientation tangential to a radius from an axis 52 of rotation of rotor 20 to a radius 54 of the rotor. The axis of passage 47 during this turn is in a plane at right angles to rotor rotation axis 52. The passage in the turn has an inside wall 56 and an outside wall 58. The inside wall curvature is constant and relatively small for a substantial distance from entrance 46 and then the inside wall curvature becomes relatively greater until the passage becomes purely radial. During the turn from circumferential to radial, the cross section of passage 47 changes from circular to a long and narrow slot through a series of generally oval shapes with the ovular cross sections being wide towards the outer wall and narrow toward the inner wall. The configurations of the cross sections will be discussed in greater detail shortly.

The passage after the circumferential to radial transition becomes purely radial at 48 and for a radial distance of substantially constant cross section. The length of purely radial and substantially constant cross-sectional area straightens the flow of fluid prior to fluid entry into a diffuser section 60 (FIG. 2). The flow is straightened so that passage affects upstream of the diffuser will not cause flow separation in the diffuser. The diffuser converts some velocity head to pressure head in a known manner. The diffuser has a progressively increasing cross-sectional area toward axis 52. This area increase is in the dimension facing the rotational direction of the rotor, as seen in FIG. 2. The dimension of the purely radial portion of the passage of the pitot tube in the plane of rotor rotation is constant. After the diffuser section, a right angle bend 62 directs the fluid into axial section 50 of passage 47 for discharge and work. The passage in this bend increases in cross section and progresses from a symmetrical oval (FIG. 10) through triangles having bases on an inside curve 64 (FIG. 11) to circular at the very exit into section 50 (FIG. 3).

Figure 12:
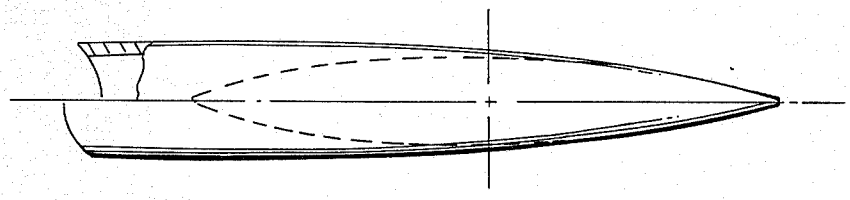
FIG. 12 is a top view of the pitot tube of FIGS. 2 and 3.

As seen in FIG. 12, the exterior surface of the pitot tube is shaped to minimize drag and is streamlined. A trailing edge 66 is slightly sharper than slightly blunter leading edge 68.

To here, then, passage 47 takes fluid from a radial limit of the rotor and conducts that fluid around a bend slightly greater than 90° so that fluid flows radially. To get rid of all entrance affects and of the affects of making the turn prior to a change of velocity head to pressure head, a straightener section of the passage directs fluid flow through constant cross section without bends. After straightening, fluid enters a diffuser section where velocity head is converted to pressure head for discharge. This path from entrance 46 to passage 50 must be traversed with as little loss as possible for an efficient pump. The losses associated with fluid turning the bend from the entrance to radial passage 48 are minimized in the following manner.

Initially fluid directed on inside bend 56 sees a wall with a gradual turn. Accordingly, the rate of increase in pressure along the flow passage and next to the wall which would encourage boundary layer separation is small. However, the constraints of the design require that the bend be sharpened to fully orient the passage in the radial direction. By this time, the cross-sectional area of the passage has changed from the circular to a section which is very long relative to its width, as seen progressively in FIGS. 4 through 9. It is believed that this change of cross section reduces losses. The cross-sectional configuration of the passage at various stations is shown in FIGS. 4 through 9. The FIG. 4 cross section is fairly close to the circular entrance, as illustrated. Here an upper portion of the passage 69, at relatively large radii, is still circular but the lower portion of the passage, at relatively small radii, is defined by converging straight walls 70 and 72, which are connected at an apex by a concave upward wall 74, at minimum passage radius. Thus the cross section approaches an asymmetrical oval, asymmetrical about a horizontal line in the Figure. The largest area for fluid flow is on the outside of the turn, the outside being towards the top in FIG. 4. This condition persists in FIG. 5 where the outside of the turn at this station, indicated at 76, still has the same radius of curvature as in FIG. 4, but perimetric extent of the arc is foreshortened considerably over that shown in FIG. 4. The arc curvature of the wall changes into converging V-shape walls 76 and 78 through sharp radii 80 and 82, and at the base of the V the lines are connected by a concave upward wall 84. Again in the FIG. 5 cross section there is generally more area available for fluid flow at larger radii (obviously in the arc, the area decreases with increasing radius).

The progression started from the purely circular through FIG. 5 configuration is continued into FIG. 6 where outside wall 86 is of the same radius of curvature but the circular extent of it is much, much less. Again, side walls 88 and 90 of the passage are straight lines converging towards the inside of the turn and are connected by a concave upward wall 92. The FIG. 6 configuration continues but in FIG. 7 the curvature on an outside wall 94 has become considerably greater, the radius of curvature being considerably smaller, and the cross section is marked by slightly converging side walls 96 and 98 connected by arcs of small radius and concave towards the passage on the outside of the turn 94 and on the inside of the turn at 100. In FIG. 8, the progression continues with the radius of the outside of the bend 102 being smaller still and the curvature being that much greater. The radius on the inside 104 of the bend has become slightly larger than in the case of FIG. 7. Again, side walls 106 and 108 are straight and converge towards the inside of the bend. However, when the cross section shown in FIG. 9 is reached, side walls 110 and 112 are not straight but instead are on a very large radius and fair into more sharply curved ends 114 and 116. This is the state of the cross section in the straightener section and is maintained throughout that section. In the diverging section of the pitot passage the configuration is more as shown in FIG. 10, which is approaching elliptical.

It should be noted that the width of the passage between entrance 46 and radial portion 48 never exceeds the diameter at the entrance. Thus, the dimension facing fluid flow outside the pitot tube is established by the entrance dimension. The cross-sectional area changes only slightly over the same distance.

Figure 10:
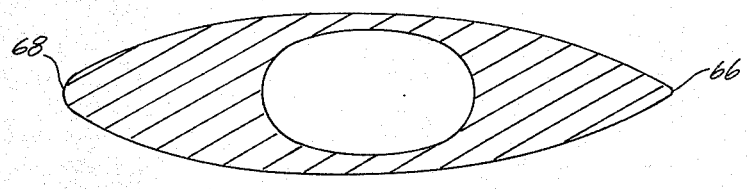
FIG. 10 is a view taken along line 10—10 of FIG. 2.
Figure 11:
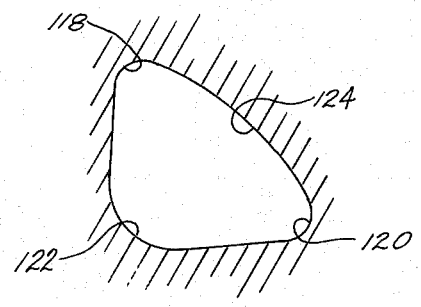
FIG. 11 is a view taken along line 11—11 of FIG. 2.

FIG. 10 also shows the entrance to the bend from the purely radial portion of the passage to the purely axial and that bend progresses from the cross section shown in FIG. 10 to the purely circular in a manner shown in FIG. 11. There a generally triangular cross section is shown with corners 118, 120 and 122 of the triangle being rounded, a base 124 of the triangle being on the inside of the turn, and an apex (corner 122) of the triangle being on the outside of the turn. The triangle is isosceles. The change in cross section around the bend is gradual.

The present invention has been described with reference to certain preferred embodiments. The spirit and scope of the appended claims should not, however, necessarily be limited to this description.

What is claimed is:

1. An improvement in a centrifugal pump of the pitot type, the pump having a housing, a rotor journaled in the housing for rotation and imparting energy to a fluid in response to a prime mover, means to supply fluid to the rotor, and a pitot tube in the rotor having a passage for receiving energized fluid from the rotor and discharging the fluid from the pump, the improvement comprising:

a. an entrance to the pitot tube passage which has a substantially circular cross-sectional area, and which is on a radius from the axis of rotation of the rotor and in a plane containing such axis;

b. a radial section of the pitot tube passage which extends substantially radially of the axis of rotation of the rotor and which has a cross-sectional area with a long and narrow perimeter at the largest radii thereof, the long portions of the perimeter being substantially normal to the axis of rotation of the rotor; and c. a transitional section of the pitot tube passage between the entrance and the radial section turning gradually and having cross sections which have substantially ovular perimeters, the width of the ovular cross sections being generally greatest at larger radii, and the cross sections being symmetrical about a bisecting plane normal to the axis of rotation.

2. The improvement claimed in claim 1 wherein the ovular cross sections are defined by sides which converge with smaller radii and an outer arc which joins the sides and has the same radius of curvature as the entrance, the perimetric extent of the arcs of the cross sections becoming increasingly smaller along the transitional passage section as the radial passage section is approached.

3. The improvement claimed in claim 2 wherein the radial passage section has a portion of substantially constant cross-sectional area, such section having the long and narrow perimeter and joining a radial inward diffuser portion of the radial passage which has a progressively increasing cross-sectional area as the axis of rotor rotation is approached.

4. The improvement claimed in claim 3 wherein the diffuser portion of the radial passage has substantially parallel walls in planes parallel to the axis of rotation and diverging walls in planes normal to the parallel walls.

5. The improvement claimed in claim 4 wherein the diffuser portion of the passage joins an axial portion of the passage through a bend, the axial portion having a circular cross section, the bend having isosceles triangular cross sections with the bases of the triangles being on the inside of the bend and an apex of the triangles being on the outside of the bend, the triangular cross sections smoothly merging into the diffuser and axial portion of the passage.

6. In a pitot tube pump having a rotor adapted to be driven in rotation about an axis of rotation by a prime mover and to energize a fluid, a cavity in the rotor for receiving the energized fluid, passage means to the rotor for supplying the fluid, and a pitot tube in the cavity having a passage for receiving energized fluid, an improvement which comprises:

a. an entrance to the pitot tube passage which has a circular cross section and which is oriented to face fluid in the cavity which is circulating circumferentially about the axis of rotor rotation;

b. a radial section of the pitot tube passage which has a long and narrow perimeter at least at the greatest radius thereof, the narrow portion of this perimeter generally paralleling the axis of rotor rotation; and c. a transition section of the pitot tube passage between the entrance and the radial passage section which has generally ovular cross sections, the ovular cross sections narrowing as the radial passage section is approached within each such cross section faster at smaller radii than at larger radii.

7. The improvement claimed in claim 6 wherein the transition section bends from the entrance to the radial passage section with a larger radius of curvature from the entrance than into the radial section.

8. The improvement claimed in claim 7 wherein the ovular cross sections are defined by V-shaped sides which apex at the smallest radii of the sections and which are capped by an arc of the same radius as the entrance, the cap of each cross section progressively shortening as the radial passage section is approached.

9. The improvement claimed in claim 8 wherein the radial passage section has a portion of substantially constant cross-sectional area, such section having the long and narrow perimeter and joining a radial inward diffuser portion of the radial passage which has a progressively increasing cross-sectional area as the axis of rotor rotation is approached.

10. The improvement claimed in claim 9 wherein the pitot tube has a hub, the pitot tube passage bending from radial of the rotor axis of rotation to coaxial with such axis through the hub, the hub bend having triangular cross sections with bases of such sections being on the inside of the hub bend and apexes of such sections being on the outside of the hub bend.

11. The improvement claimed in claim 10 wherein the radial passage section has a diffuser terminating at the hub bend.

12. The improvement claimed in claim 11 wherein the exterior of the pitot tube is streamlined.

* * * * *